US009109401B1

(12) United States Patent
Calvert

(10) Patent No.: US 9,109,401 B1
(45) Date of Patent: Aug. 18, 2015

(54) REPETITIVE CHARGE SEISMOLOGY UNIT

(71) Applicant: RCSU Associates, Trustee for Repetitive charge seismology unit CRT Trust, Manassas, VA (US)

(72) Inventor: S. Mill Calvert, Manassas, VA (US)

(73) Assignee: RCSU Associates, Trustee for Repetitive charge seismology unit CRT Trust, Manassas, VA (US)

( * ) Notice: Subject to any disclaimer, the term of this patent is extended or adjusted under 35 U.S.C. 154(b) by 0 days.

(21) Appl. No.: 14/709,429

(22) Filed: May 11, 2015

(51) Int. Cl.

| | |
|---|---|
| ***E21B 4/06*** | (2006.01) |
| ***E21B 7/26*** | (2006.01) |
| ***E21B 44/00*** | (2006.01) |
| ***E21B 4/14*** | (2006.01) |

(52) U.S. Cl.
CPC ... *E21B 4/06* (2013.01); *E21B 4/14* (2013.01); *E21B 7/26* (2013.01); *E21B 44/005* (2013.01)

(58) Field of Classification Search
CPC ..... E21B 4/06; E21B 4/08; E21B 4/10; E21B 4/12; E21B 4/14; E21B 4/145; E21B 7/26; E21B 44/005
USPC ..... 175/293–306, 414
See application file for complete search history.

(56) References Cited

U.S. PATENT DOCUMENTS

| | | | | | |
|---|---|---|---|---|---|
| 2,544,573 | A | * | 3/1951 | Price | 175/4.5 |
| 3,070,010 | A | * | 12/1962 | Robinson, Jr. | 175/4.5 |
| 3,083,778 | A | * | 4/1963 | Friedman et al. | 175/4.5 |
| 3,404,919 | A | * | 10/1968 | Dixon | 299/13 |
| 3,768,408 | A | | 10/1973 | Hallmark | |
| 4,030,557 | A | * | 6/1977 | Alvis et al. | 175/4.5 |
| 4,208,966 | A | | 6/1980 | Hart | |
| 6,758,124 | B2 | | 7/2004 | Barker et al. | |
| 8,763,507 | B2 | | 7/2014 | Ross | |
| 8,943,944 | B2 | | 2/2015 | Zhang et al. | |

* cited by examiner

*Primary Examiner* — Blake Michener
(74) *Attorney, Agent, or Firm* — Louis Ventre, Jr.

(57) ABSTRACT

A device for penetrating the earth includes a hollow cylindrical housing holding a computer controller that automatically controls the device. A battery within the housing supplies power for the components. A hydraulic system within the housing engages the earth to resist movement of the housing when required and to push the housing downward if needed. A drill head shaft slides up and down within the housing. The main body of the drill head is located below the housing. The drill head has a diameter that is larger than that of the housing. A semi-auto cartridge chamber within the housing cyclically fires cartridges above the shaft to propel it downward. When the housing is not heavy enough to resist upward reaction thrust from a cartridge explosion or to fall downward following the drill head then the computer activates the hydraulic system to engage the earth.

3 Claims, 4 Drawing Sheets

REPETITIVE CHARGE SEISMOLOGY UNIT

TECHNICAL FIELD

In the field of boring or penetrating the earth or other geological formation, a self-acting apparatus is disclosed having subject matter directed to exploding a charge in an inaccessible hole to propel a drill-head portion of the apparatus into the formation. Successive charges enable cyclic advance of the apparatus into the formation.

BACKGROUND ART

The long history of earth is one of vast geological tumult and change. As new continents have been formed, large land masses have broken apart or collided and combined with great pressures exerted on tectonic plates. This great pressure and movement on these tectonic plates over time has created many earthquakes and seismic fault lines to appear.

Measuring seismic waves with surface instrumentation is many centuries old. As long ago as 132 AD, Zhang Heng of China's Han dynasty invented a functional seismic detector. This was a large bronze vessel, about 2 meters in diameter. At eight positions around the top of the vessel were dragon's heads holding bronze balls. When an earthquake occurred, the internal mechanisms would react to the direction of the seismic waves and cause one of the mouths to open and drop its ball into a bronze toad at the base, making a sound and supposedly showing the direction of the earthquake.

Small movements of the earth can foreshadow larger events to follow. Typically, earth movements have been detected by a variety of sensors placed on or near the surface. Currently, electronic sensors also mounted at the surface are used to provide broadband radio-frequency detection covering a wide range of frequencies produced by earth movements. Some seismometers can measure motions with frequencies from 500 Hz to 0.00118 Hz (1/500=0.002 seconds per cycle, to 1/0.00118=850 seconds per cycle). Greater sensitivity can be obtained if underground devices directly measure earth movements and frequencies that are too weak to be detected above noise distortion at the surface.

If one looks to the history of large earthquakes over our long history on earth, it becomes alarmingly clear that the number of large quakes has drastically gone up over the last 15 years. We are living in a time of large-scale quakes, and because of overpopulation and lax earthquake-resistant building codes, significant populations live in areas where survival is influenced by earthquake dangers.

Down-hole instrumentation for seismological purposes is sometimes used by creating a borehole from the surface. For example, triaxial sensors have been employed down a borehole to measure ground motion and the potential for seismic amplification at surface structures, such as bridges. Such seismic engineering practice requires a costly and complex drilling operation to remove the earth to create multiple smooth boreholes and then lowering the instrumentation package from the surface down each such borehole to the measurement locations.

SUMMARY OF INVENTION

A device for penetrating the earth includes a hollow cylindrical housing holding a computer controller that automatically controls the device. A battery within the housing supplies power for the components. A hydraulic system within the housing has at least two arms that extend outward from the housing to engage the earth to resist movement of the housing with respect to the earth when required and to push the housing downward if needed. A drill head has a main body and a shaft. The shaft slides up and down within a shaft chamber in the housing. The main body is located below the housing. The main body is conically shaped at least at its bottom which rises from a pointed end. The main body has a base opposite the pointed end. The base has a diameter that is larger than that of the housing so that when it is propelled downward it compresses the earth to form a bore larger in diameter than the housing. A cartridge chamber within the housing holds a cartridge blank that is made to discharge an explosive charge above the shaft and propel it downward within the shaft chamber, pushing the main body into the earth below the housing. Once discharged the cartridge blank is ejected from the cartridge chamber and a new cartridge blank is inserted into the cartridge chamber from a magazine within the housing. The drill head may incorporate passages that form a pathway for rubble to flow from under the drill head to above it. When the housing is not heavy enough to sufficiently resist upward reaction thrust from a cartridge explosion or to fall downward after such explosion, then the computer activates the hydraulic system to engage the earth prior to causing the cartridge chamber to discharge the cartridge blank, or after such explosion to push the housing downward.

Technical Problem

To aid in seismological research, it would be helpful to have a simple and easy apparatus to deliver scientific earthquake sensors and other test equipment directly to these underground fault regions. Such an apparatus could deliver data useful for predicting the location and likelihood of future massive quakes or provide data for evaluation of engineered surface structures. Such an apparatus could help to save tens of millions of lives and countless billions of dollars in property damages.

Solution to Problem

The solution that will advance earthquake science research has arrived with the invention of the repetitive charge seismology unit. With the repetitive charge seismology unit, researchers can now place a whole variety of research equipment directly into these underground fault zones and key tectonic locations.

The repetitive charge seismology unit works by having a hardened metal drill head that has a conical or bullet-shaped nose slidably engaged with a hollow cylindrical housing holding computer-operated hydraulics and test equipment. A magazine within the housing holds blank cartridges with high explosives that are repetitively discharged to drive the drill head downward in increments, which compresses the surrounding earth so that a borehole larger than the housing results. As the blank cartridges are fired, the discharge propels the drill head downward a limited distance creating a hole with a diameter larger than the housing. Then, gravity and/or the hydraulics cause the housing to drop lower into the earth to follow the drill head.

After a blank cartridge is fired, the magazine automatically inserts a new blank cartridge from the magazine into the firing chamber for a repeat of the process. Each charge that explodes lowers the repetitive charge seismology unit lower into the earth. This repetitive explosion and lowering process would continue until the unit is at the desired depth along the fault line or tectonic plate.

A payload compartment in the housing holds various scientific research and other equipment, which is conveyed to the underground location for operation by the computer. The computer automatically implements the operational functions of the unit and saves and transmits the data retrieved to the surface using an antenna that employs the earth as a conduction pathway or utilizes a conduction line connected to the surface. A satellite broadcast unit may be employed to relay the data received to remote receivers.

The repetitive charge seismology unit is a beneficial technology that will give scientists the ability to place equipment throughout various underground fault lines to be able to start accurately predicting where and when our future big quakes may occur.

Advantageous Effects of Invention

The repetitive charge seismology unit will give scientists a low cost and easy way to place various research equipment underground in the fault and tectonic plate zones or simply under an engineered structure.

Researchers can place a large number of seismic-sensing equipment all along these faults. They may now be able to place new types of earthquake equipment such as pressure sensors that will measure the pressure on tectonic plate edges and junctions with known fault lines.

With the ability of the repetitive charge seismology unit to easily place this equipment underground, it will be possible to monitor plate pressure and any changes on plate pressure along fault lines. The repetitive charge seismology unit data can be relayed to satellites for transmission to far away research centers, leading to a potential to better predict possible coming quakes before any destructive seismic activity takes place.

BRIEF DESCRIPTION OF DRAWINGS

The drawings illustrate preferred embodiments of the repetitive charge seismology unit according to the disclosure. The reference numbers in the drawings are used consistently throughout. New reference numbers in FIG. 2 are given the 200 series numbers. Similarly, new reference numbers in each succeeding drawing are given a corresponding series number beginning with the figure number.

DESCRIPTION OF EMBODIMENTS

In the following description, reference is made to the accompanying drawings, which form a part hereof and which illustrate several embodiments of the present invention. The drawings and the preferred embodiments of the invention are presented with the understanding that the present invention is susceptible of embodiments in many different forms and, therefore, other embodiments may be utilized and structural, and operational changes may be made, without departing from the scope of the present invention.

Figure 1:
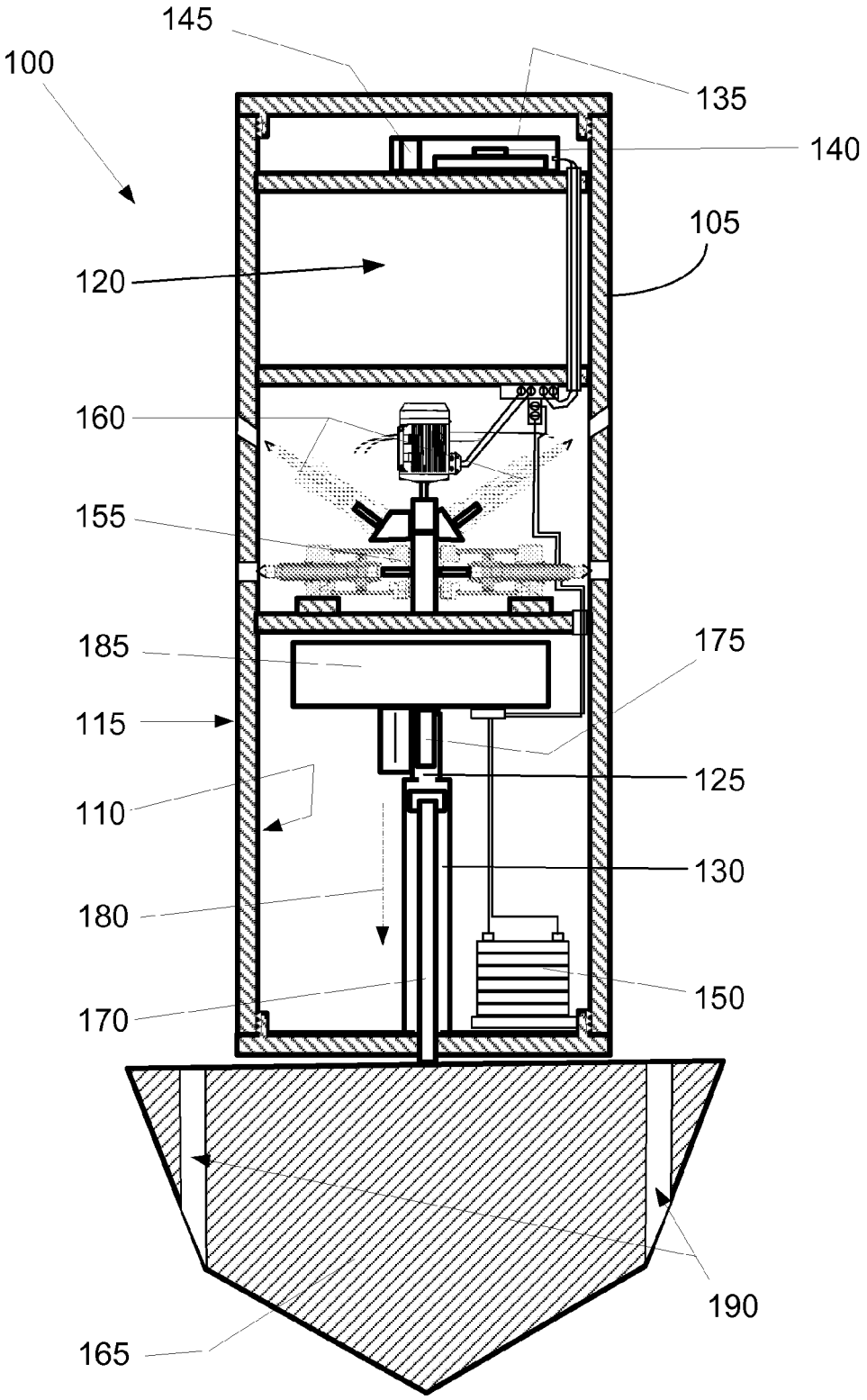
FIG. 1 is a sectional elevation view of a preferred embodiment of the device termed a repetitive charge seismology unit.
Figure 2:
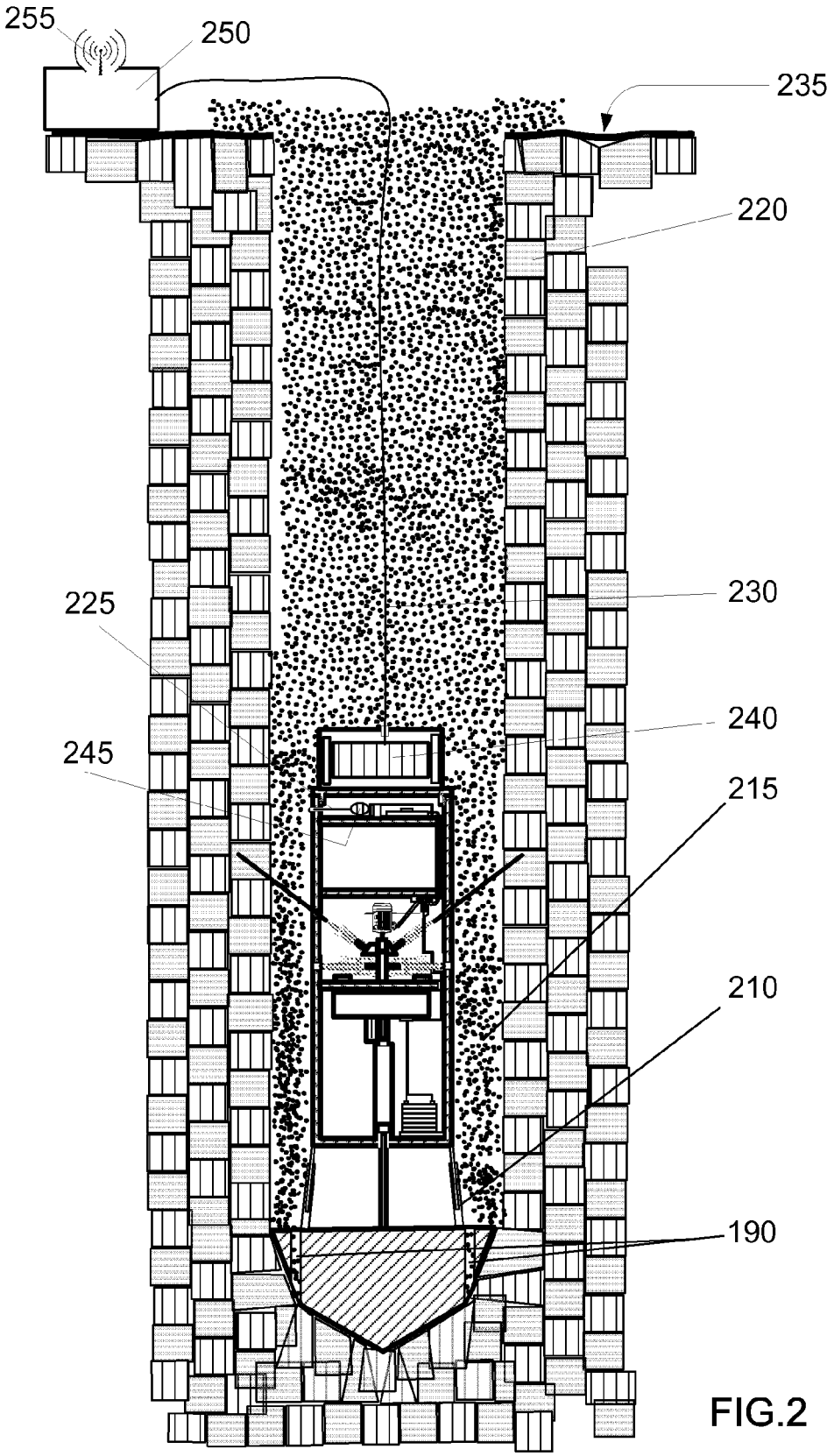
FIG. 2 is a sectional elevation view of a second preferred embodiment of the device shown in a geological setting.
Figure 3:
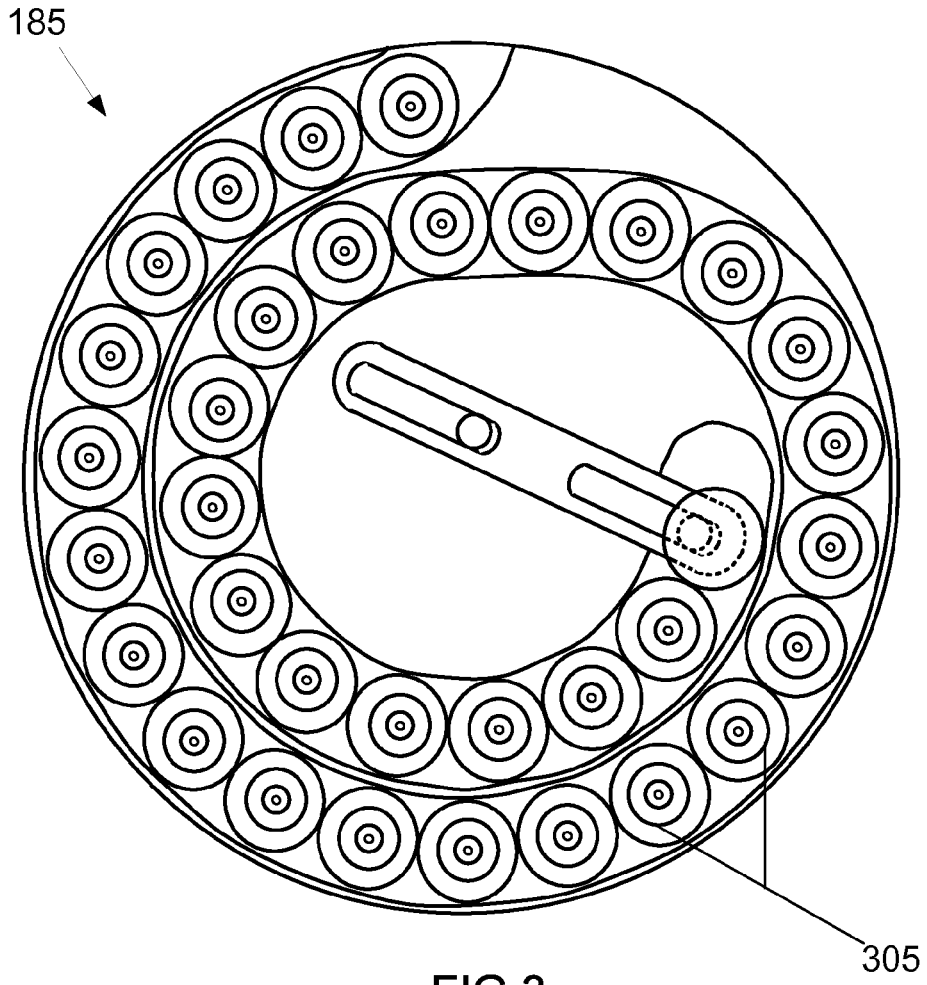
FIG. 3 is a sectional top view of a magazine showing an assemblage of cartridge blanks within.
Figure 4:
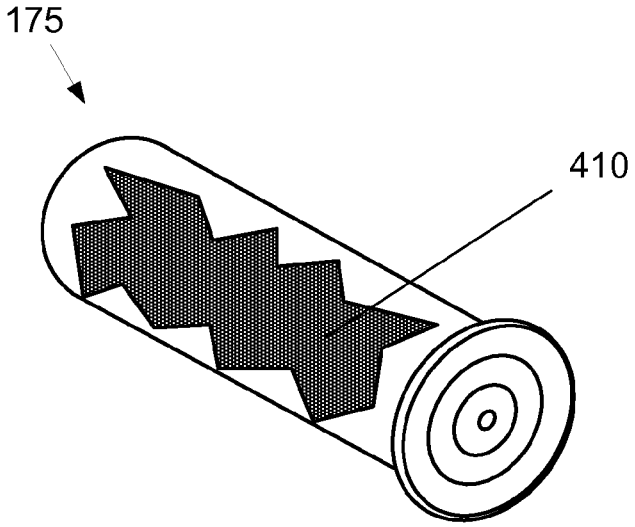
FIG. 4 is a perspective of a cartridge blank with a cut-out showing the explosive charge within.
Figure 5:
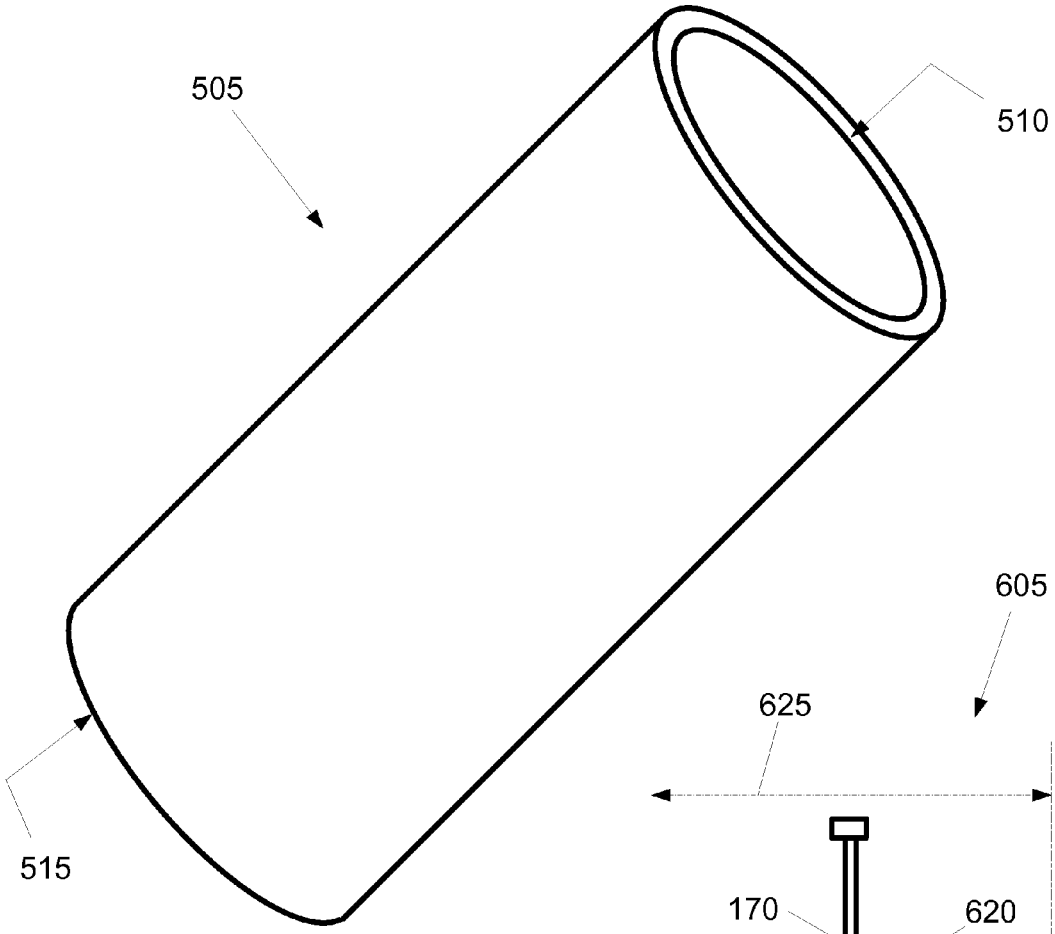
FIG. 5 is a perspective of a tubular configuration of a housing in a preferred embodiment of the device.
Figure 6:
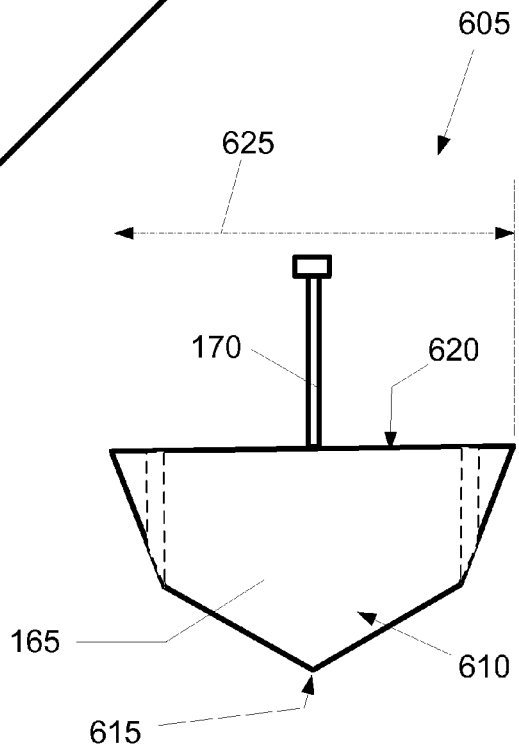
FIG. 6 is an elevation view of a drill head in a preferred embodiment of the device.

FIG. 1 is a sectional elevation view of a preferred embodiment of a device (100) also referred to herein as a repetitive charge seismology unit. The device (100) is for penetrating the earth (220) as an aid in seismological studies or to pursue other purposes requiring entry into the earth or other geological structure, such as regolith on the moon or other planet. In this sense, use of the term "earth" herein is meant to encompass all types of geology on Planet Earth and other bodies in the solar system.

The preferred embodiment of the device (100) includes a housing (105); a computer controller (135); a battery (150); a hydraulic system (155); a drill head (605); a cartridge blank (175); and a magazine (185) for semi-auto loading of cartridge blanks.

The housing (105) has a tubular configuration (505) because it is shaped like a pipe and is a long, hollow cylinder. The housing (105) preferably is closed off at the ends by covers or lids, which are preferably removably screwed on and off, but may also be attached in other ways.

As with a pipe of limited length, the housing (105) has an inner wall (110), an outer wall (115), a top end (510), and a bottom end (515). The housing (105) is the structure that holds or guides the components of the device (100) as it works its way into the earth (220).

The housing (105) preferably defines one or more chambers within the pipe structure. These chambers are defined in a variety of embodiments to include: a payload compartment (120) that is used to convey instruments or such other components as may be desired into the ground; a cartridge chamber (125), much like the chamber in a firearm, where the cartridge chamber (125) is used to hold and discharge a cartridge blank (175) that has an explosive charge (410); a shaft chamber (130) in fluid communication with the cartridge chamber (125), where the shaft chamber (130) holds and confines upward and downward travel of the shaft (170) of the drill head (605).

The computer controller (135) is situated within the housing (105). The computer controller (135) includes a central processing unit (140) and non-transitory computer memory (145) storing program instructions implemented by the central processing unit (140) to automatically control the device (100) once it begins its drilling operation. An antenna (225) energized by a data receiver/transmitter (245) is preferably operated by the computer controller (135) to receive instructions from the surface and convey data generated by the instruments in the payload compartment (120). Transmission signals from the device (100) are preferably propagated by conduction through the earth or via a conductor wire (230) extending from the surface (235) and fed out from a coil (240) within or attached to the housing (105). A surface transmitter (255) provides a means to send data obtained from sensors on the device (100) to a remote receiving station. The surface transmitter (255) either receives signals through the earth (220) or via the conductor wire (230). The conductor wire (230) is fed out from the coil (240) as the housing (105) sinks into the earth (220).

The battery (150) supplies power to the computer controller (135), the battery (150) is positioned within the housing (105). If a conductor wire (230) is employed, the battery (150) may be connected to a power source (250) on the surface (235).

The hydraulic system (155) is within the housing (105). The hydraulic system (155) includes at least two arms (160) that extend outward from the outer wall (115) of the housing (105) to engage the earth (220). The computer controller (135) is optionally programmed to extend the arms of the hydraulic system (155) to engage the earth (220) prior to causing the cartridge chamber (125) to discharge the cartridge blank (175). This may not be needed because the weight of the device (100) should be sufficient in most applications to avoid the need for such engagement with the earth (220) or bracing prior to detonating the explosive charge (410).

Thus, for some embodiments where the weight of the device (100) is insufficient to resist the reaction forces from the firing of the explosive charge (410), the hydraulic system (155) may be configured to resist movement of the housing (105) with respect to the earth (220) so that when the drill head (605) is pushed downward by firing the explosive charge, the housing (105) is not pushed up in reaction.

The hydraulic system (155) is preferably configured to push the housing (105) downward if gravity fails to lower it to the bottom of the hole created by the drill head (605). The hydraulic system (155) is powered by the battery (150) and controlled by the computer controller (135).

The drill head (605) includes two parts which are either integral components of a single unit, or two separate attached components. These two parts of the drill head (605) are the shaft (170) and the main body (165). The shaft (170) may be thought of as analogous to a piston in an internal combustion engine. The shaft (170) initially resides mostly within the confines of the shaft chamber (130) in an initial firing position near the cartridge chamber (125), analogous to a point near top dead center in an engine.

In a preferred embodiment, the shaft (170) is integrally constructed with the main body (165) as a single object. Whether attached or integrally formed, when the shaft (170) moves downward (180), the main body (165) of the drill head (605) pushes down in the earth and compresses the earth (220) down and to the side of the device (100). The main body (165) of the drill head (605) is forced downward (180) when the explosive charge (410) in the cartridge blank (175) is ignited. Downward movement of the drill head (605) creates space for the housing (105) to follow the drill head (605) down into the earth (220) either by action of gravity or by being pushed down by the hydraulic system (155).

In a preferred embodiment, the main body (165) is located below the bottom end (515) of the housing (105). The main body (165) includes a conical shape (610) for at least a portion of the drill head (605). The main body (165) rises from a distal pointed end (615), which is the tip of the conical shape (610), to a base (620). The base (620) has a diameter (625) extending beyond the outer wall (115) of the housing (105) so that the earth (220) is pushed away from the outer wall (115) of the housing (105).

The shaft (170) is configured to slide up and down in the shaft chamber (130) below the cartridge chamber (125). The downward movement of the shaft (170) is implemented by firing the cartridge blank (175). In the preferred embodiment of the device (100), the subsequent upward movement of the shaft (170) is implemented when gravity pulls the housing down to the main body (165) of the drill head (605).

The cartridge blank (175) includes an explosive charge (410). The cartridge blank (175) is adapted to be held within the cartridge chamber (125) for discharge of the explosive charge (410) within cartridge chamber (125). The cartridge blank (175) is similar to a blank cartridge in a firearm, except that the explosive charge (410) in the cartridge blank (175) has much greater propellant force than in a firearm.

The cartridge chamber (125) is configured: to hold the cartridge blank (175) in position to be discharged; to discharge the cartridge blank (175) upon command from the computer controller (135); and to eject the discharged cartridge blank (175) from the cartridge chamber (125). The cartridge blanks (175) are loaded similarly to the action in a semi-automatic firearm. The propulsive force from the explosion is channeled into the shaft chamber (130) where it then acts on the shaft (170), much like the piston in an automotive engine. The shaft (170) is adapted to be pushed downward (180) toward the bottom end (515) of the housing (105) upon discharge of the cartridge blank (175).

The magazine (185) is positioned within the housing (105) so that it can feed successive cartridge blanks into the cartridge chamber (125), much like a drum magazine for a firearm. The magazine (185) holds a plurality of cartridge blanks (305).

In an alternative embodiment, the drill head (605) is configured with passages (190) therethrough, said passages (190) enabling transit of rubble (215) from below the drill head (605) to above the drill head (605). This is an optional configuration because the drill head (605) is adapted to push open a hole by compacting the earth (220) around it, and not by creating pebbles or rubble (215).

In yet another alternative embodiment, the drill head (605) is further adapted to rotate like a drill bit to provide greater ability to penetrate hardened earth (220). For these embodiments, a rubble skirt (210) may be added to prevent rubble from collecting between the bottom end (515) of the housing (105) and the base (620) of the drill head (605).

The rubble skirt (210) slides down, telescopes out from the outer wall (115) of the housing (105), or telescope out from the bottom end (515) of the housing (105). The rubble skirt (210) preferably surrounds the outer wall (115) of the housing (105) and is connected to the drill head (605), preferably near the periphery of the base (620) of the drill head (605).

The above-described embodiments including the drawings are examples of the invention and merely provide illustrations of the invention. Other embodiments will be obvious to those skilled in the art. Thus, the scope of the invention is determined by the appended claims and their legal equivalents rather than by the examples given.

INDUSTRIAL APPLICABILITY

The invention has application to the drilling industry.

What is claimed is:

1. A device for penetrating the earth, the device comprising:

a housing comprising a tubular configuration, the housing further comprising an inner wall and an outer wall, the housing defining a payload compartment, a cartridge chamber, a shaft chamber in fluid communication with the cartridge chamber, a top end, and a bottom end;

a computer controller within the housing, the computer controller comprising a central processing unit and non-transitory computer memory storing program instructions implemented by the central processing unit to automatically control the device;

a battery supplying power to the computer controller, the battery positioned within the housing;

a hydraulic system within the housing, the hydraulic system comprising at least two arms that extend outward from the outer wall of the housing to engage the earth and configured to resist movement of the housing with respect to the earth, the hydraulic system powered by the battery and controlled by the computer controller;

a drill head comprising a main body and a shaft, the main body located below the bottom end of the housing, the main body comprises a conical shape, the main body rises from a distal pointed end to a base, the base having a diameter extending beyond the outer wall of the housing;

the shaft connected to the base, the shaft configured to slide up and down in the shaft chamber below the cartridge chamber, a cartridge blank comprising an explosive charge, the cartridge blank adapted to be held within the cartridge chamber for discharge of the explosive charge within the cartridge chamber;

the cartridge chamber configured: to hold the cartridge blank in position to be discharged; to discharge the cartridge blank upon command from the computer controller; and thereafter to eject the cartridge blank from the cartridge chamber;

the shaft adapted to be pushed downward toward the bottom end of the housing upon discharge of the cartridge blank; and a magazine within the housing, the magazine holding a plurality of cartridge blanks.

2. The device of claim 1, wherein the drill head is configured with passages therethrough, said passages enabling transit of rubble from below the drill head to above the drill head.

3. The device of claim 1, wherein the computer controller is programmed to extend the arms of the hydraulic system to engage the earth prior to causing the cartridge chamber to discharge the cartridge blank.

* * * * *